US006205303B1

(12) United States Patent
Fujii et al.

(10) Patent No.: US 6,205,303 B1
(45) Date of Patent: Mar. 20, 2001

(54) AUTOMATIC CLEANING METHOD FOR ELECTRIFIER, AND IMAGE FORMING APPARATUS

(75) Inventors: Daisuke Fujii; Kenji Fuke, both of Kawasaki; Kiyoshi Chinzei, Hyogo, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/420,007

(22) Filed: Oct. 18, 1999

(30) Foreign Application Priority Data

Feb. 4, 1999 (JP) ..... 11-027613

(51) Int. Cl.[7] ..... G03G 15/02
(52) U.S. Cl. ..... 399/100
(58) Field of Search ..... 399/100, 98, 99, 399/101, 50, 94, 97, 31; 250/324, 325, 326; 361/255, 229, 230

(56) References Cited

U.S. PATENT DOCUMENTS

| | | | | |
|---|---|---|---|---|
| 3,870,883 | * | 3/1975 | Oagley | 399/100 |
| 4,788,573 | * | 11/1988 | Nakaoka et al. | 399/100 |
| 5,194,897 | * | 3/1993 | Yoshiyama et al. | 399/100 |
| 5,384,623 | * | 1/1995 | Ohashi et al. | 399/31 |
| 5,563,692 | | 10/1996 | Cho | 399/127 |
| 5,689,770 | * | 11/1997 | Kurokawa et al. | 399/100 |
| 5,873,013 | * | 2/1999 | Matsushita et al. | 399/100 |

FOREIGN PATENT DOCUMENTS

| | | |
|---|---|---|
| 61-292654 | 12/1986 | (JP) . |
| 62-91976 | 4/1987 | (JP) . |
| 3-107877 | 5/1991 | (JP) . |
| 3-134679 | 6/1991 | (JP) . |
| 4-75070 | 3/1992 | (JP) . |
| 6-282152 | 10/1994 | (JP) . |
| 8-272169 | 10/1996 | (JP) . |

* cited by examiner

*Primary Examiner*—Arthur T. Grimley
*Assistant Examiner*—Hoan Tran
(74) *Attorney, Agent, or Firm*—Armstrong, Westerman, Hattori, McLeland & Naughton

(57) ABSTRACT

An automatic cleaning method for cleaning an electrifier of an image forming apparatus. A drive mechanism moves the cleaning member to clean the electrifier. An electrification time measuring section measures an electrification time of the electrifier after the last cleaning of the electrifier. A medium detecting section discriminates whether or not a medium is located in an image forming station. A control section controls the drive mechanism to render the cleaning member to clean the electrifier when a medium is not present in the image forming station after the measured electrification time reaches a determined time. The result is that automatic electrifier cleaning can be done at an appropriate preset timing, causing an elongated service life of the electrifier.

38 Claims, 10 Drawing Sheets

| AREA | THE NUMBER OF TIMES | COEFFICIENT |
|---|---|---|
| 1 | A | X |
| 2 | B | Y |
| 3 | C | Z |

AUTOMATIC CLEANING METHOD FOR ELECTRIFIER, AND IMAGE FORMING APPARATUS

BACKGROUND OF THE INVENTION (1) Field of the Invention

The present invention relates to an automatic electrifier cleaning method suitably applicable to the cleaning of an electrifier (electrifying device) of a printing apparatus based on an electrostatic developing system, and further to an image forming apparatus.

(2) Description of the Related Art

In general, contaminants such as toner and dust float in the interior of a printing apparatus (image forming apparatus), and these contaminants adhere to chassis, corona wires and other parts of a pre-electrifier and a transfer electrifier during the printing operation of the printing apparatus. Further, these contaminants accumulate with the use of the apparatus to cause a reduction of discharge efficiency, the discharge irregularity or the like in the electrifier, which leads to various troubles or problems such as the deterioration of print quality.

For this reason, in order to maintain the print quality of the printing apparatus, a need exists that a maintenance person or the user cleans or replaces the electrifier periodically. This electrifier cleaning work requires considerable skills, for that, for example, its corona wire is constructed using an extremely thin wire having a diameter of approximately 80 $\mu$m. Additionally, replacing the electrifier frequently is troublesome, which results in an increase in maintenance cost for the printing apparatus.

Thus, there has been known a printing apparatus which has been made such that a cleaning pad is brought into contact with a corona wire or the like of an electrifier and moved in parallel with the corona wire or the like through the use of a motor or the like to automatically clean the electrifier regularly.

However, in a conventional image forming apparatus, the electrifier is cleaned at a given interval, that is, the electrifier is cleaned automatically even in the case that print paper lies in the vicinity of an image forming drum, with the result that contaminants, such as toner and dust, removed from the electrifier by the cleaning adhere to the paper so that the print quality can deteriorate.

In addition, in the recent years, with the spread of laser printers and others, the using environment of the printing apparatus has come into variety or versatility, and an approach of cleaning the electrifier at a given interval like the above-described conventional automatic electrifier cleaning apparatus cannot remove the contamination of the electrifier sufficiently, thus making it difficult to eliminate various troubles and problems such as the deterioration of print quality resulting from a reduction of discharge efficiency and discharge irregularity of the electrifier.

Conceivably, the period of cleaning the electrifier would be shortened in order to prevent the discharge efficiency reduction and the discharge irregularity of the electrifier. However, this creates a problem in that the wear of its corona wire advances more quickly, which leads to shortening the life of the electrifier.

Still additionally, there is a need to once cease the printing operation of the printing apparatus at the cleaning of the electrifier, and in the case of cleaning the electrifier at a given interval like the conventional automatic electrifier cleaning apparatus, an interruption of the printing operation can take place periodically, which causes a reduction of the printing speed and interferes with the speed-up of the printing processing. This is particularly noticeable in the case of shortening the cycle of the cleaning of the electrifier.

SUMMARY OF THE INVENTION

The present invention has been developed in consideration of these problems, and it is therefore an object of this invention to provide an automatic cleaning method and an image forming apparatus which are capable of lengthening the life of an electrifier by designing the cleaning timings at the automatic cleaning of the electrifier.

For this purpose, in accordance with this invention, there is provided an automatic cleaning method of automatically cleaning, with a cleaning member, an electrifier which forms an image on medium, the method comprising the steps of measuring an electrification time of the electrifier after the last electrifier cleaning, discriminating whether or not the medium is located at an image forming station, and cleaning the electrifier with the cleaning member if the medium is absent at the image forming station after the electrification time reaches a first predetermined time.

Furthermore, in accordance with this invention, there is provided an image forming apparatus equipped with an electrifier which performs an electrifying operation to form an image on a medium, the image forming apparatus comprising a cleaning member for cleaning the electrifier, a drive mechanism for moving the cleaning member to clean the electrifier, an electrification time measuring section initialized at completion of cleaning of the electrifier for measuring an electrification time by the electrifier after the completion of the cleaning of the electrifier, a medium detecting section for discriminating whether or not the medium is located at an image forming station where an image is formed on the medium, and a control section for controlling the drive mechanism to move the cleaning member so as to clean the electrifier when the medium detecting section discriminates the absence of the medium at the image forming station after the electrification time measured by the electrification time measuring section reaches a first predetermined time.

Thus, the automatic cleaning method and the image forming apparatus according to this invention are capable of cleaning the electrifier without interfering with the printing operation and, hence, can prevent the reduction of the printing speed concurrently with preventing contaminants such as toner and dust produced by the cleaning from adhering to the medium to degrade the print quality, and additionally, are capable of suppressing the wear of the electrifying member to lengthen the life of the electrifier, thus accomplishing a high economy.

Besides, it is also appropriate that the cleaning member is operable to clean the electrifying member when an image forming operation of the image forming apparatus is stopped after the electrification time reaches a second predetermined time subsequent to the first predetermined time.

Accordingly, the automatic cleaning method and the image forming apparatus according to this invention permits the cleaning of the electrifier without hindering the printing operation and, hence, can eliminate the interference with the printing work.

In addition, it is also acceptable that, if the electrification time reaches a third predetermined time subsequent to the predetermined time without the stopping of the image forming operation, the image forming operation is temporarily stopped even before the electrifying member is cleaned with the cleaning member.

Accordingly, the automatic cleaning method and the image forming apparatus according to this invention can remove the contaminants such as toner and dust attached to the electrifying member to prevent the impairment of the print quality.

Still additionally, it is also acceptable that, when the image forming operation is to be temporarily stopped, the control section issues a request for a stop of image data transmission to a host unit which transmits image data to the image forming apparatus, or that the number of times of cleaning operation by the cleaning member is determined according to how the electrifier has been used, whereupon the cleaning operation performs by the cleaning member according to the determined number of times.

Accordingly, the automatic cleaning method and the image forming apparatus according to this invention can surely stop the image forming operation. Additionally, since the contamination of the electrifier can surely be removed according to how the electrifier has been used, it is possible to prevent the impairment of the print quality, and further, since the wear of the electrifying member is suppressible, it is possible to lengthen the life of the electrifier economically.

Incidentally, the using situation can be an electrification time, or can also be the temperature or humidity in the image forming apparatus.

Accordingly, the automatic cleaning method and the image forming apparatus according to this invention can easily and certainly determine the number of times of cleaning operation.

Furthermore, in accordance with this invention, there is provided an automatic cleaning method for automatically cleaning, with a cleaning member, an electrifier for an image forming apparatus which forms an image on an image forming drum electrified by the electrifier and transfers the image from the image forming drum onto a medium for an image forming on the medium, the image forming apparatus having an electric potential control function to control an electrification potential of the electrifier in accordance with a surface electric potential of the image forming drum, the method comprising a step of determining the target (desired) electrification potential for the electrifier by the electric potential control function of the image forming apparatus, and cleaning an electrifying member of the electrifier when a difference between the determined target (desired) electrification potential for the electrifier and a predetermined reference potential exceeds a first predetermined value.

Still further, in accordance with this invention, there is provided an image forming apparatus which forms a transfer image, to be transferred onto a medium, on an image forming drum electrified by an electrifier to transfer the transfer image from the image forming drum onto the medium for an image forming on the medium and which has an electric potential control function to control an electrification potential of the electrifier while determining a target electrification potential for the electrifier in accordance with a surface electric potential of the image forming drum, the image forming apparatus comprising a cleaning member for cleaning the electrifier, a drive mechanism for moving the cleaning member for cleaning the electrifier, and a control section for controlling the drive mechanism to move the cleaning member so as to clean the electrifier when a difference between the target electrification potential for the electrifier determined by the electric potential control function and a predetermined reference potential exceeds a first predetermined value.

Thus, with the automatic cleaning method and the image forming apparatus according to this invention, when a need for cleaning occurs because of being attached contaminants such as toner onto an electrifying member, the cleaning of the electrifying member becomes possible and the dirt of the electrifying member is surely removable irrespective of the electrifier using circumstances, which can prevent the impairment of the print quality. Additionally, the wear of the electrifying member is suppressible, thus lengthening the life of the electrifier, which is economical.

Besides, it is also appropriate to issue an alarm when the difference between the target electrification potential for the electrifier and the predetermined reference potential exceeds a second predetermined value greater than the first predetermined value, or to raise an alarm when the difference between the target electrification potential for the electrifier determined by the electric potential control function immediately after the cleaning by the cleaning member and the predetermined reference potential exceeds the first predetermined value.

Furthermore, it is also appropriate that an alarm issuing section is provided which issues an alarm under control of the control section and the control section makes the alarm issuing section issue an alarm when the difference between the target electrification potential for the electrifier and the predetermined reference potential exceeds the second predetermined value greater than the first predetermined value, or that an alarm issuing section is provided which issues an alarm under control of the control section and the control section makes the alarm issuing section issue an alarm when the difference between the target electrification potential for the electrifier, which potential is determined by the electric potential control function immediately after the cleaning by the cleaning member and the predetermined reference potential exceeds the first predetermined value.

Accordingly, the automatic cleaning method and the image forming apparatus according to this invention permit the operator or the like to be alerted to the fact that the electrifier is not restorable to its target electrification potential only by the cleaning of the electrifying member, which enables the operator or the like to cope with it quickly. Additionally, since being alerted to the fact that the electrifier cannot achieve its target electrification potential even if the electrifying member is cleaned, the operator or the like can take measures quickly.

Besides, it is also appropriate that the predetermined reference potential is a target electrification potential for the electrifier determined by the electric potential control function immediately after the cleaning member initially cleans the electrifier.

Accordingly, by the employment of the automatic electrifier cleaning method or the image forming apparatus according to this invention, it is possible to construct an image forming apparatus easily, which leads to a reduction of the manufacturing cost.

Moreover, in accordance with this invention, there is provided an image forming apparatus including an electrifier for performing an electrifying operation for an image forming on a medium, and further comprising a cleaning member for cleaning the electrifier and a drive mechanism for moving the cleaning member to clean the electrifier, wherein the cleaning member is constructed to be attachable and detachable with respect to the drive mechanism and is incorporated into an electrifer unit including the electrifier while the drive mechanism is provided on a body side of the image forming apparatus, and the cleaning member is detached from the drive mechanism at replacement of the electrifier unit and is replaced together with the electrifier.

Thus, the image forming apparatus according to this invention does not require the replacement of the drive mechanism at replacement of the electrifier unit and, hence, can economically lessen the cost needed for the replacement of the electrifier unit.

Besides, in the case a plurality of electrifiers are used, it is also possible that the cleaning members provided for cleaning the respective electrifiers are integrated and the integrated cleaning members are moved by one drive mechanism.

Accordingly, the image forming apparatus according to this invention can economically simplify its own structure.

Moreover, it is also appropriate that the drive mechanism comprises a joining section to be joined to the cleaning members and a drive section for moving the joining section along the electrifiers, wherein the joining section includes a contacting section to be brought into contact with the cleaning members at setting of the electrifier unit for positioning the cleaning members and a fixing mechanism for fixing the cleaning members, positioned by the contacting section, with respect to the contacting section.

Accordingly, the image forming apparatus according to this invention permits the cleaning member to be certainly and easily fixed to the joining section, which improves the working efficiency at the setting of the electrifier unit.

Additionally, it is also appropriate that an image forming drum for forming an image to be transferred onto the medium is provided and the electrifier unit is integrated with a drum unit including the image forming drum so that the electrifier unit, together with the image forming drum, is replaced at the replacement of the drum unit.

Accordingly, the image forming apparatus according to this invention allows easy replacement of the electrifier unit and the image forming drum, thus enhancing the working efficiency.

DESCRIPTION OF THE PREFERRED EMBODIMENTS

Figure 1:
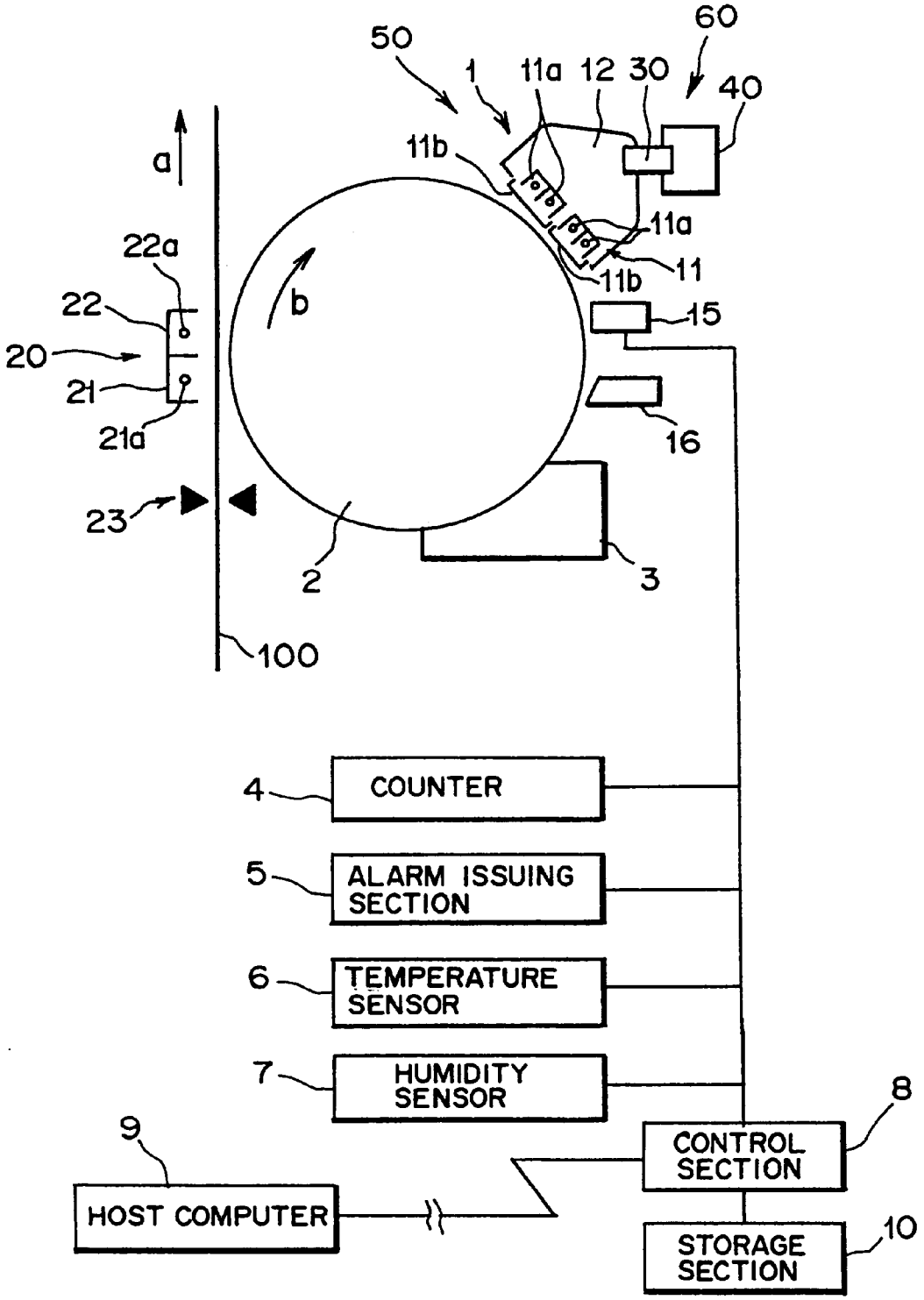
FIG. 1 is a side elevational view illustratively showing a configuration of an image forming apparatus according to a first embodiment of the present invention.

Referring to the drawings, a description will be made hereinbelow of embodiments of the present invention.

(A) Description of a First Embodiment

Figure 2:
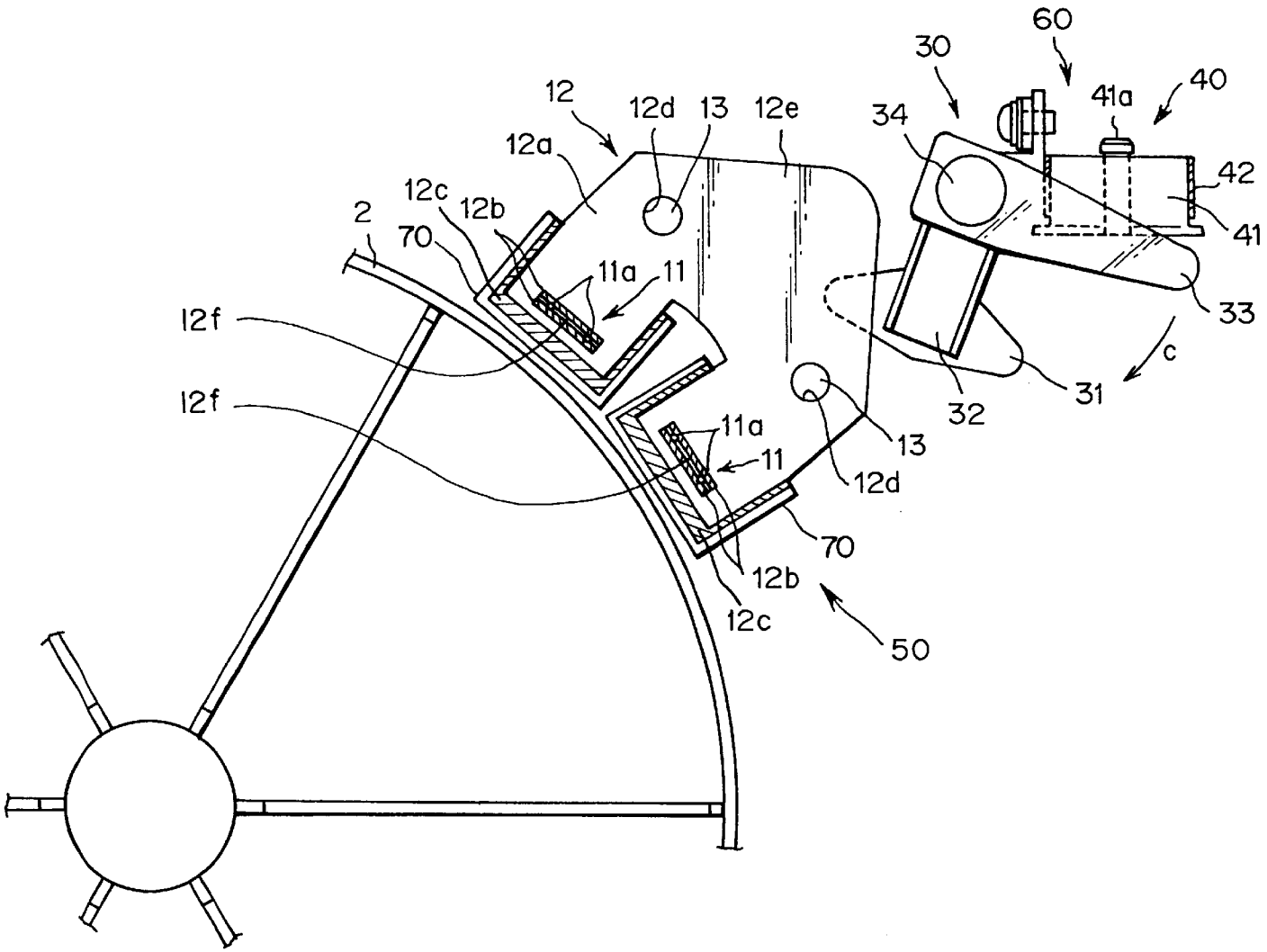
FIG. 2 is a side elevational view illustratively showing a configuration of a pre-electrifier unit of the image forming apparatus according to the first embodiment of this invention.
Figure 3:
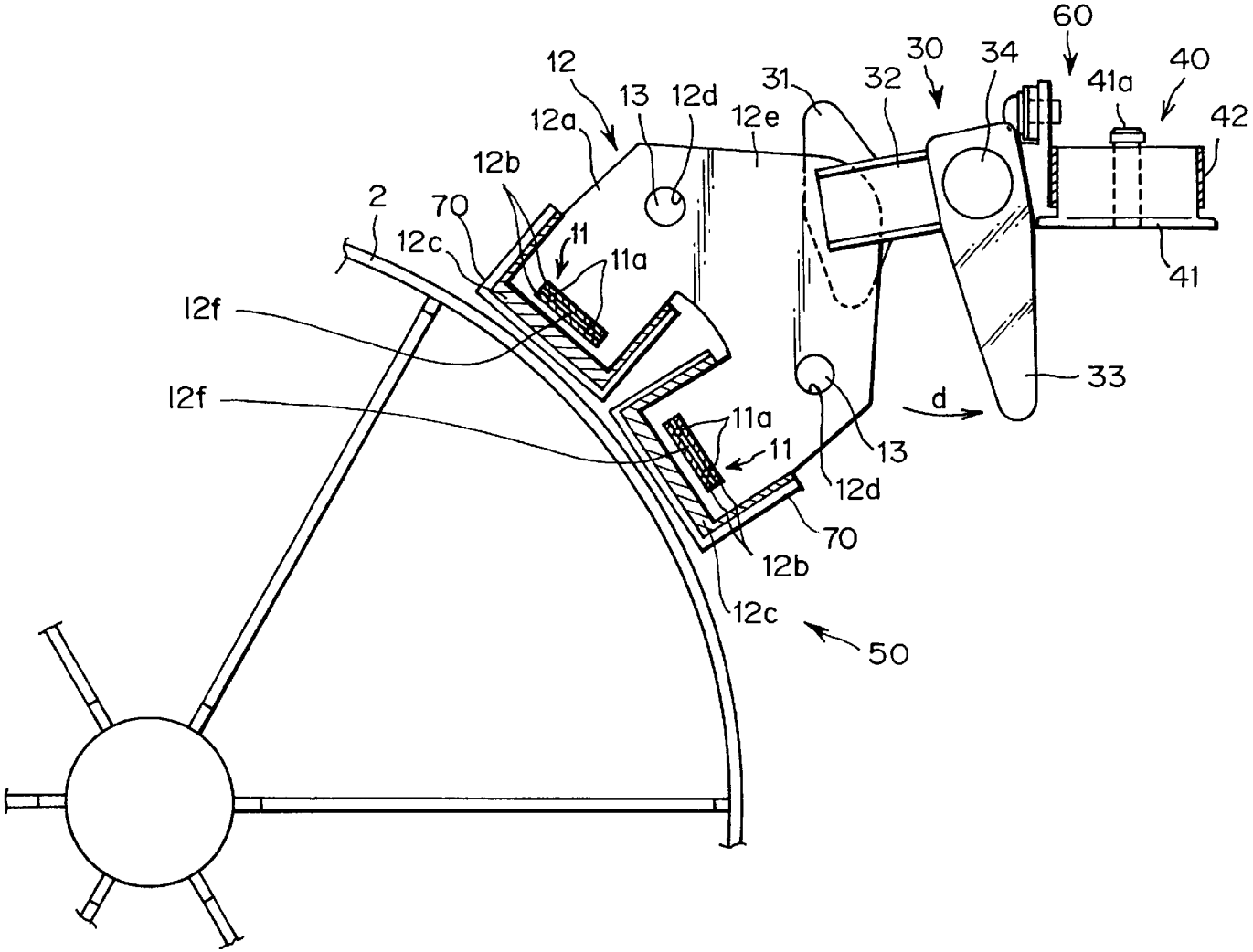
FIG. 3 is a side elevational view illustratively showing a configuration of the pre-electrifier unit of the image forming apparatus according to the first embodiment of this invention.
Figure 4:
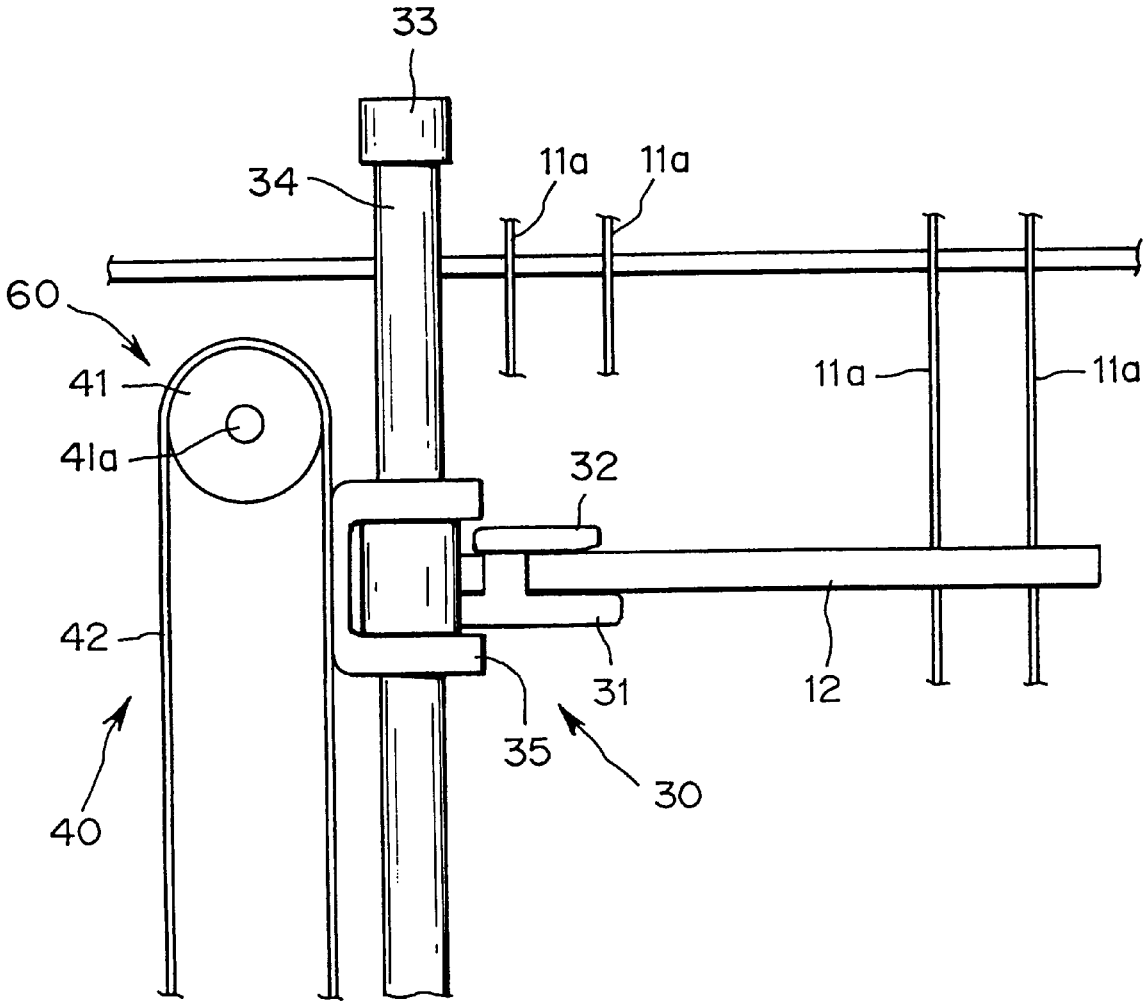
FIG. 4 is a plan view illustratively showing a configuration of a joining section of the image forming apparatus according to the first embodiment of this invention.
Figure 5:
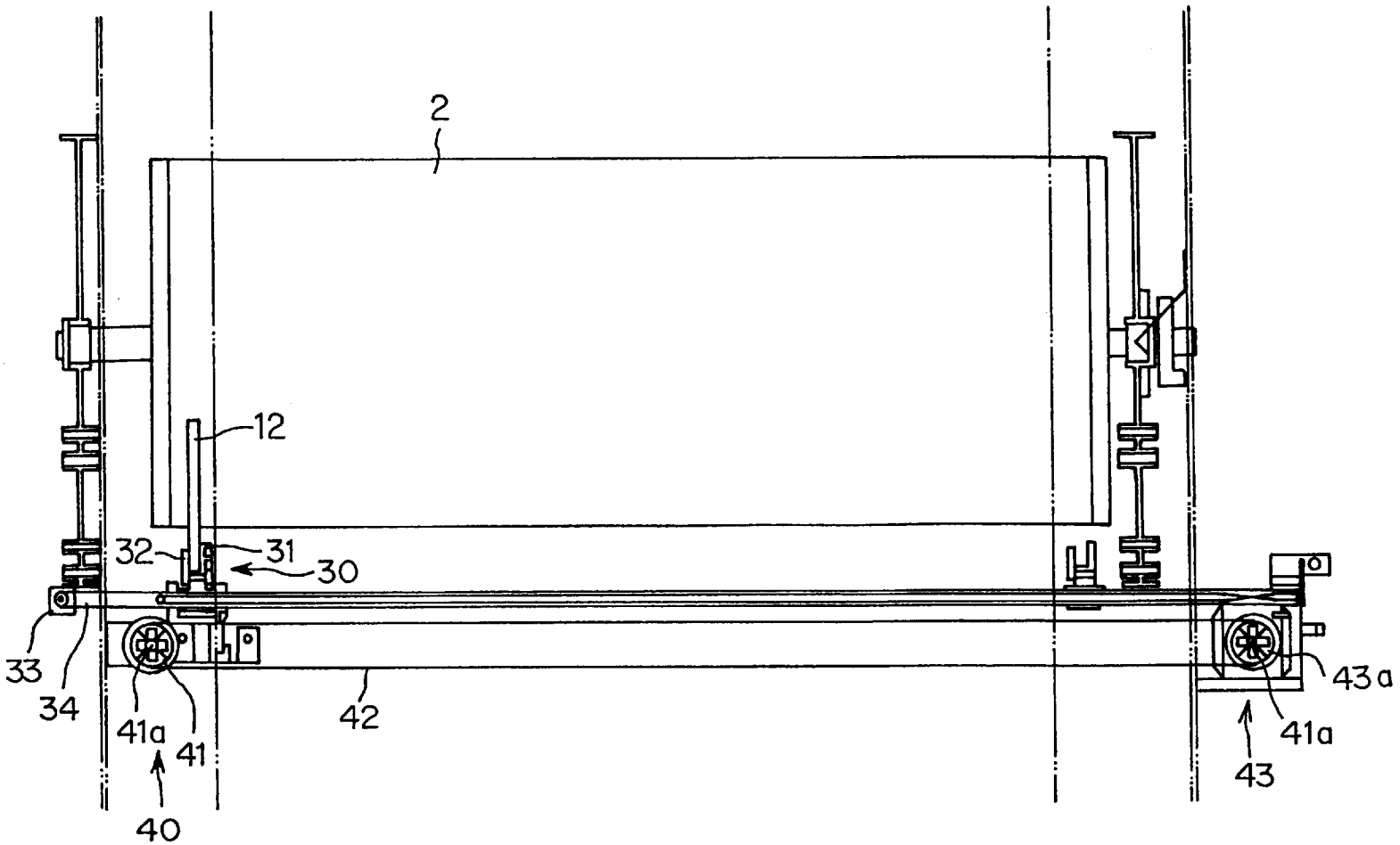
FIG. 5 is a plan view illustratively showing a configuration of a drive mechanism of the image forming apparatus according to the first embodiment of this invention.

FIG. 1 is a side elevational view illustratively showing a configuration of an image forming apparatus according to a first embodiment of the present invention, FIGS. 2 and 3 are side elevational views illustratively showing a configuration of a pre-electrifier unit 1 thereof, FIG. 4 is a plan view illustratively showing a configuration of a joining section 30, and FIG. 5 is a plan view illustratively showing a configuration of a drive mechanism 60 thereof.

An image forming apparatus according to the first embodiment of this invention is, as shown in FIG. 1, composed of a pre-electrifier unit (electifier unit) 1, a photosensitive drum (image forming drum) 2, a developing unit 3, an exposure LED 16, a transfer section 20, a surface potential detecting section 15, a paper sensor (medium detecting section) 23, a counter (electrification time measuring section) 4, an alarm issuing section 5, a temperature sensor 6, a humidity sensor 7, a control section 8, a storage section 10 and a drive mechanism 60. This image forming apparatus is for receiving image data transmitted from a host computer (host unit) 9 to print it on printing paper (medium) 100. That is, in this image forming apparatus, this printing paper 100 is conveyed by a non-shown conveying system and a toner image corresponding to the image data is formed on an outer circumferential surface of the photosensitive drum 2 and transferred onto a surface of the printing paper 100 in the transfer section 20 and then the non-fixed toner image on the printing paper 100 is fixed in a non-shown fixing section, thereby accomplishing the printing onto the printing paper 100.

The photosensitive drum 2 is made to rotate (see an arrow b in FIG. 1) in a conveying direction (a direction indicated by an arrow a in FIG. 1) while coming into contact with the printing paper 100. By the contact of the photosensitive drum 2 with the surface of the printing paper 100, the toner image formed on its outer circumferential surface is transferred onto the printing paper 100.

On the downstream side of the transferring position to the printing paper 100 on the outer circumferential section of the photosensitive drum 2, there is situated the pre-electrifier unit 1 comprising a pre-electrifier (electrifier) 11 and a cleaning member 12.

The pre-electrifier 11 is composed of corona wires (electrifying members) 11*a* and grids 11*b*, and the control section 8 controls a grid voltage to the grids 11*b*, thereby electrifying the outer circumferential surface of the photosensitive drum 2 uniformly.

The pre-electrifier 11 of the image forming apparatus according to the first embodiment has four corona wires 11*a* as shown in FIGS. 1 to 5.

The cleaning member 12 is for cleaning the pre-electrifier 11, and is, as shown in FIGS. 2 and 3, composed of a supporting plate 12*a* and cleaning pads 12*b*, 12*c*. Incidentally, in FIGS. 2 and 3, the cleaning pads 12*b*, 12*c* are indicated with oblique lines.

Each pair of cleaning pads 12*b*, 12*b* are fixedly secured to the supporting plate 12*a* so that they hold the corona wires 11*a* therebetween while coming into contact with them, and the cleaning pads 12*c* are fixed thereto to come into contact with chassises 70. These cleaning pads 12*b*, 12*c* are made from a sponge-like elastic material in which an artificial leather, an abrasive or the like is applied dispersedly.

In the supporting plate 12*a*, each of slits 12*f* is made between each of the pairs of cleaning pads 12*b*, 12*b* to allow penetration of the corona wires 11*a*. Further, the grids 11*b* are formed/attached in/to the chassises 70 (see FIGS. 2 and 3; omitted from FIG. 1).

The supporting plate 12*a* is a plate-like member which is driven along the corona wires 11*a* and the chassis 70 by the drive mechanism 60 while supporting the cleaning pads 12*b*, 12*c*. In the supporting plate 12*a*, there are made holes 12*d* for penetration of guides 13 placed in parallel with the photosensitive drum 2 and the corona wires 11*a*. With the guides 13 installed integrally with the photosensitive drum 2 penetrating into these holes 12*d*, the cleaning member 12 is set to be slidable in parallel with the corona wires 11*a* while being guided by these guides 13.

Furthermore, on the opposite side to the chassises 70 and the corona wires 11*a* in the supporting plate 12*a*, a projecting section 12*e* is formed to be caught in the joining section 30 which will be described herein later.

Still further, the cleaning member 12 is designed to clean a plurality of (4 in this first embodiment) corona wires 11*a* simultaneously.

Besides, the pre-electrifier unit 1 is constructed integrally with the photosensitive drum 2, and in this apparatus, when the photosensitive drum 2 is detached from the main body, the pre-electrifier unit 1, together with the photosensitive drum 2, is also detached from the apparatus body.

The pre-electrifier unit 1 and the photosensitive drum 2 constitute the drum unit 50, and the pre-electrifier unit 1 is replaced together with the photosensitive drum 2 at replacement of the drum unit 50.

Moreover, in this apparatus, the photosensitive drum 2 (drum unit 50) is made to be pulled out and taken out from the apparatus body in a direction of its rotary shaft (for example, a front side direction of paper of FIG. 1). At the replacement of the drum unit 50, when the photosensitive drum 2 is pulled out from the apparatus body, the pre-electrifier unit 1 constructed integrally with the photosensitive drum 2, together with it, is also pulled out from the apparatus body.

At a position on the downstream side of the pre-electrifier unit 1 along the outer circumferential section of the photosensitive drum 2, a surface potential detecting section 15 is provided to measure the electric potential of the outer circumferential surface of the photosensitive drum 2, with the surface potential of the photosensitive drum 2 detected by the surface potential detecting section 15 being supplied to the control section 8.

Furthermore, on the main body side of this apparatus, the drive mechanism 60 is provided to move the cleaning member 12 for the purpose of cleaning the pre-electrifier 11. This drive mechanism 60 is made up of a drive section 40 and the aforethe joining section 30.

The drive section 40 is equipped with a belt 42, a pulley 41 and a drive motor 43. As shown in FIG. 5, the endless belt 42 is provided in parallel with the photosensitive drum 2 and the corona wires 11*a* and one side (left side in FIG. 5) of the belt 42 is set on the pulley 41 fitted rotatably over a shaft 41*a*. Further, the other side (right side in FIG. 5) is set on a pulley 43*a* attached to the drive motor 43, and a carrier 35 of the joining section 30, which will be described herein later, is fixedly secured to the belt 42.

The drive section 40 rotates the pulley 43*a* by rotationally driving the drive motor 43, thus rotationally driving the belt stretched between the pulley 41 and the pulley 43*a*. Whereupon, the joining section 30 fixed to the belt 42 is moved in parallel with the corona wires 11*a*.

Furthermore, the moving direction of the joining section 30 is switched by the switching of the rotating direction of the drive motor 43.

The joining section 30 is for attaching/detaching the cleaning member 12 to/from the drive section 30, and is, as shown in FIGS. 2 to 4, made up of a shaft 34, a carrier 35, a holding member (fixing mechanism) 32, a stopper (contacting portion) 31 and a lever 33.

Incidentally, in FIG. 4, a portion of the corona wires 11*a*, the photosensitive drum 2 and others are omitted for convenience sake.

As FIG. 4 shows, the carrier 35 is a member having a U-like cross section configuration, and is mounted on the shaft 34, installed throughout the entire width (axial length) of the photosensitive drum 2 in parallel with the photosensitive drum 2 and the corona wires 11*a*, to be slidable therealong. Further, a surface opposite to the opening portion of the U-like configuration of the carrier 35 (left-hand surface in FIG. 4) is fixedly secured to the belt 42.

In addition, the stopper 31 and the holding member 32 is set in the opening portion of the U-like configuration of the carrier 35 to be held in the carrier 35 and to be slidable with respect to the shaft 34. The stopper 31 and the holding member 32 is made to move in directions parallel to the photosensitive drum 2 and the corona wires 11*a* with the movements of the carrier 35.

Still additionally, the stopper 31 and the holding member 32 are spaced by a distance substantially equal to the thickness dimension (dimension perpendicular to the paper carrying FIGS. 2 and 3) of the projecting portion 12*e* of the supporting plate 12*a* so that the projecting portion 12*e* is held between the stopper 31 and the holding member 32.

Furthermore, the stopper 31 and the holding member 32 is made to rotate by a predetermined angle (for example, approximately 60°) around the shaft 34 with the rotation of the lever 33. For instance, as shown in FIG. 1, when the lever 33 is rotated by a given angle in a direction indicated by an arrow c in a state where the holding member 32 is at its lowest position, the stopper 31 and the holding member 32 hold the projecting portion 12*e* of the supporting plate 12*a* therebetween to fix the cleaning member 12.

In this way, the cleaning member 12 is connected and fitted to the drive section 40 through the use of the joining section 30.

Moreover, as FIG. 3 shows, when the lever 33 is rotated by a given angle in a direction indicated by an arrow d in a state where the projecting portion 12*e* is held between the stopper 31 and the holding member 32, the stopper 31 and the holding member 32 are also rotated in the arrow d direction around the shaft 34 so that the projecting portion 12*e* is separated from between the stopper 31 and the holding member 32 so that the cleaning member 12 is detached from the drive section 40.

That is, the cleaning member 12 is made to be attachable and detachable to and from the drive section 40 through the use of the joining section 30. For instance, at the replacement of the drum unit 50, after the cleaning member 12 is separated from the drive section 40 by using the joining section 30, the drum unit 50 is taken out from the apparatus body.

Furthermore, as FIGS. 2 and 3 show, the stopper 31 has a greater area than that of the holding member 32, and even in a state where the projecting portion 12*e* is released from the condition held by the holding member 32 and the stopper 31 in a manner that the lever 33 is rotated by a given angle in the arrow d direction in FIG. 3, the stopper 31 is brought into contact with the projecting portion 12*e*.

Still further, at the replacement of the drum unit 50, for mounting the drum unit 50 to the apparatus body, the drum unit 50 is inserted into the apparatus body in the direction of the rotary shaft of the photosensitive drum 2.

At this time, on the apparatus body side, the joining section 30 is placed on the front side in the rotating direction of the photosensitive drum 2, that is, at an insertion opening side (left side in FIG. 5) position of the photosensitive drum 2 (the position of the joining section 30 relative to the photosensitive drum 2 will sometimes be referred hereinafter to as a home position), while, when the photosensitive drum 2 is inserted in a state where the cleaning member 12 of the pre-electrifier unit 1 is shifted, even if slightly, to the inserting direction side in directions along the shaft of the photosensitive drum 2, that is, to the inmost side (right side in FIG. 5) of the apparatus body relative to the photosensitive drum 2, at the mounting of the drum unit 50 to the apparatus body, the projecting portion 12*e* of the cleaning member 12 runs against the stopper 31 of the joining section 30 to position the cleaning member 12, thus surely fixing the projecting portion 12*e* of the cleaning member 12 by the stopper 31 and the holding member 32.

Besides, at this time, if the drum unit 50 is inserted in a state where the joining section 30 is situated at the home position on the apparatus body side and, in relation to the photosensitive drum 2, the cleaning member 12 of the pre-electrifier unit 1 is located at the innermost side (right side in FIG. 5) position in the inserting direction along the shaft of the photosensitive drum 2, at the insertion thereof, the cleaning member 12 slides in the rotary shaft direction of the photosensitive drum 2 while being supported by the stopper 31 of the joining section 30, thereby cleaning the pre-electrifier 11.

Besides, in this apparatus, each of the levers and others is provided with a mechanical interlock feature. Thus, for instance, if the lever 33 takes a position at which the cleaning member 12 is not fixed by the stopper 31 and the holding member 32 (see FIG. 2), a cover of a non-shown device is made so as not to take a closing condition, and the printing processing is inhibited in this case.

When, in the drive section 40, the drive motor 43 is rotated in a given direction under control of the control section 8, the belt 42 is rotationally driven while being guided by the pulleys 43*a*, 41, and the cleaning member 12 is moved in parallel with the corona wires 11*a* through the joining section 30 fixed to the belt 42.

Furthermore, in the pre-electrifier unit 1, with the movements of the cleaning member 12, the cleaning pads 12*b* of the cleaning member 12 reciprocate along the axial directions of the photosensitive drum 2 in a state of coming into contact with the corona wires 11*a* while the cleaning pads 12*c* reciprocate along the axial directions thereof in a state of coming into contact with the chassises 70, thereby removing the contaminants such as toner and dust attached to the corona wires 11*a* and the chassises 70.

The exposure LED 16 is installed at a position on the downstream side of the surface potential detecting section 15 existing relative to the outer circumference of the photosensitive drum 2. This exposure LED 16 comprises an LED head and others constituting an optical unit for exposure for applying an optical image corresponding to an image to be printed to the outer circumferential surface of the photosensitive drum 2 to form an electrostatic latent image thereon.

At a position on the downstream side of the exposure LED 16 existing on the periphery of the outer circumference of the photosensitive drum 2, there is located the developing unit 3 which is for developing the electrostatic latent image formed by the exposure LED 16 to produce a toner image.

At a position on the downstream side of the developing unit 3 standing in relation to the outer circumference of the photosensitive drum 2, the photosensitive drum 2 is made to come into contact with printing paper 100, and at this contacting position, that is, at a position being in opposed relation to the photosensitive drum 2 with the printing paper 100 being interposed therebetween, there is located the transfer section 20 comprising a transfer electrifier 21 and a separation electrifier 22.

The transfer electrifier 21 generates a corona discharge through the use of a corona wire 21*a* at an electric potential, reverse in polarity to the electrification potential for the toner image, from the rear side of the printing paper 100 (left side in FIG. 1) at the contacting position between the photosensitive drum 2 and the printing paper 100, thereby electrifying the printing paper 100 so that the toner image is taken and transferred onto the printing paper 100. Additionally, adjacent to the transfer electrifier 21 and on the downstream side thereof in the printing paper 100 conveying path, there is situated the separation electrifier 22 which generates a corona discharge through the use of a corona wire 22*a* so that the printing paper 100 is released from the electrification to facilitate the separation of the printing paper 100 from the photosensitive drum 2.

On the upstream side of the transfer section 20 in the printing paper 100 conveying path, provided is the paper sensor (medium detecting section) 23 for sensing the presence of the printing paper 100, that is, for detecting the presence or absence of the printing paper 100 printable (image-producible) in this image forming apparatus. This paper sensor 23 is, for example, composed of a pair of optical sensors, that is, a light-emitting portion and a light-receiving portion, and detects the presence or absence of the printing paper 100 in the transfer section 20 on the basis of the interception by the printing paper 100 between the light-emitting portion and the light-receiving portion.

Incidentally, although, in the first embodiment, the paper sensor 23 is made up of a pair of optical sensors, this invention is not limited to this, but covering all changes and modifications, such as a roller type sensor and a lever type sensor, which do not constitute departures from the spirit and scope of the invention.

The counter 4 counts the number of copies or prints (here after called "copies") to the printing paper 100 (the number of printing paper 100 put to use for printing) after the completion of cleaning of the pre-electrifier 11 under the control of the control section 8. Because the number of copies to the printing paper 100 is basically in proportion to the time of electrification by the pre-electrifier 11, this counter 4 functions as an electrification time measuring section to measure the electrification time of the pre-electrifier 11 after the completion of cleaning of the pre-electrifier 11.

Incidentally, if the printing paper 100 is a continuous form, the counter 4 measures the number of copies on the assumption that a portion between successive perforations made in the printing paper 100 corresponds to a piece of printing paper.

Furthermore, the counter 4 is initialized at the time of the completion of the cleaning of the pre-electrifier 11, and again counts the number of copies after the completion of the automatic cleaning of the pre-electrifier 11.

Besides, the counter 4 transmits, to the control section 8, the information about the counted number of copies to the printing paper 100.

The temperature sensor 6 measures the temperature in this apparatus, while the humidity sensor 7 measures the humidity in this apparatus, with the temperature and the humidity measured being forwarded to the control section 8.

The control section 8 is for controlling the operation of each of parts of this apparatus in accordance with an instruction transmitted from the host computer 9. As will be described herein later, the control section 8 compares the number of copies to the printing paper 100, measured by the counter 4, with first to third predetermined values (the number of paper) to make a decision on the timing for the cleaning of the pre-electrifier 11.

Concretely, when detecting the absence of the printing paper 100 through the paper sensor 23 after the number of copies counted by the counter 4 reaches the first predetermined value (for example, 4000 pieces), the control section 8 makes the cleaning member 12 clean the pre-electrifier 11 at this detection timing.

Furthermore, when, after reaching 4000, the number of copies measured by the counter 4 comes to the second predetermined value (for example, 10000 pieces) without detection of the absence of the printing paper 100 by the paper sensor 23, the control section 8 cleans the pre-electrifier 11 through the use of the cleaning member 12 at the timing of detecting the fact that the image forming operation is in stop.

Still further, when, after reaching 10000, the number of copies measured by the counter 4 comes to the third predetermined value (for example, 20000 pieces) without stop of the image forming operation, the control section 8 makes a request for stop of data transmission to the host computer 9 being a host unit and then cleans the pre-electrifier 11 through the use of the cleaning member 12.

Moreover, the control section 8 is made to determine the number of times (repetitions) of cleaning operation (cleaning implementation) by the cleaning member 12 at the cleaning according to the using situation of the pre-electrifier 11. Concretely, the control section 8 determines the number of times of cleaning operation at the cleaning of the pre-electrifier 11, that is, the number of times of reciprocation of the cleaning member 12 along the corona wires 11*a* and others, on the basis of the electrification time of the pre-electrifier 11 coupled with the temperature and the humidity in the interior of the apparatus.

Figure 6:
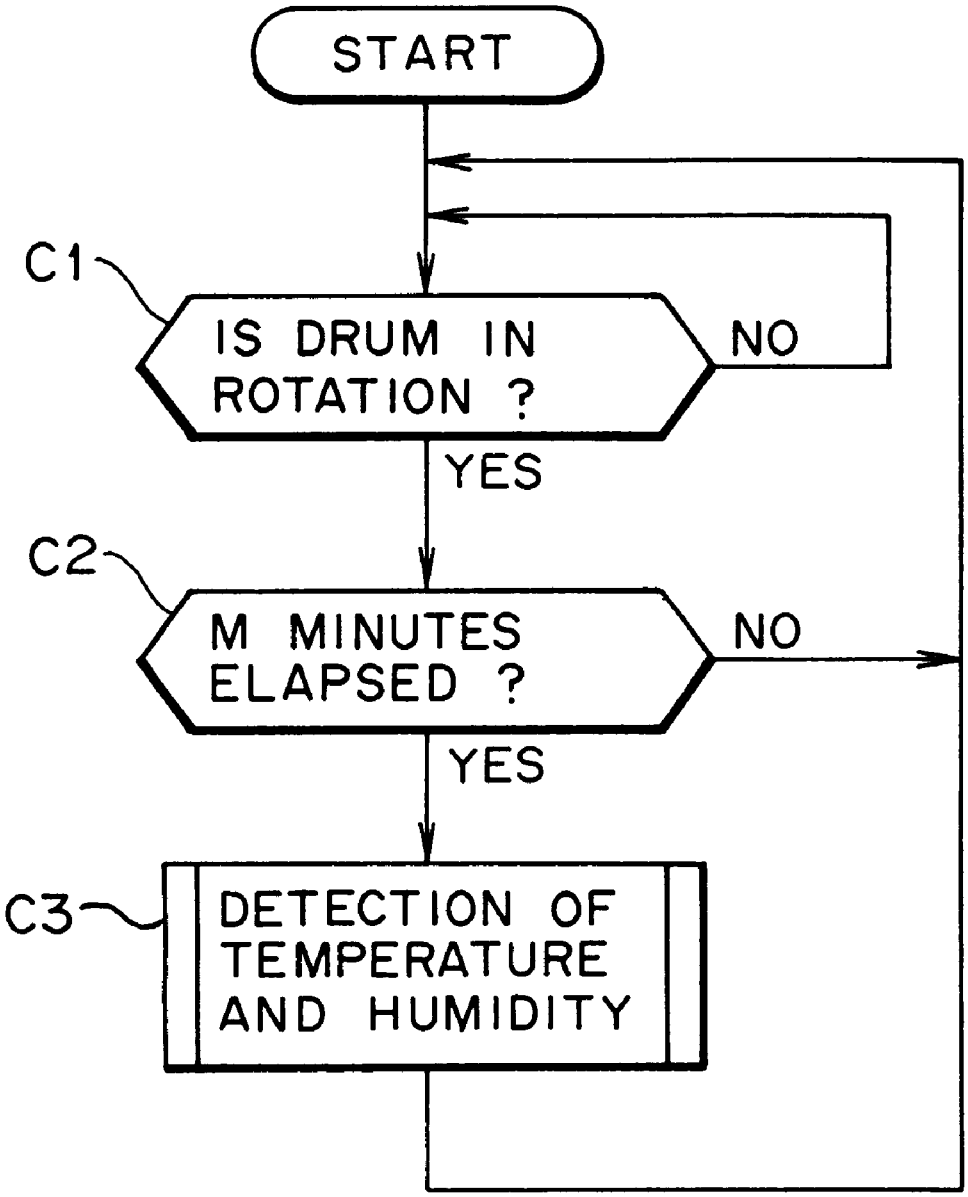
FIG. 6 is a flow chart useful for explaining the steps of determining the number of times of cleaning operation at cleaning of the image forming apparatus according to the first embodiment of this invention.
Figure 7:
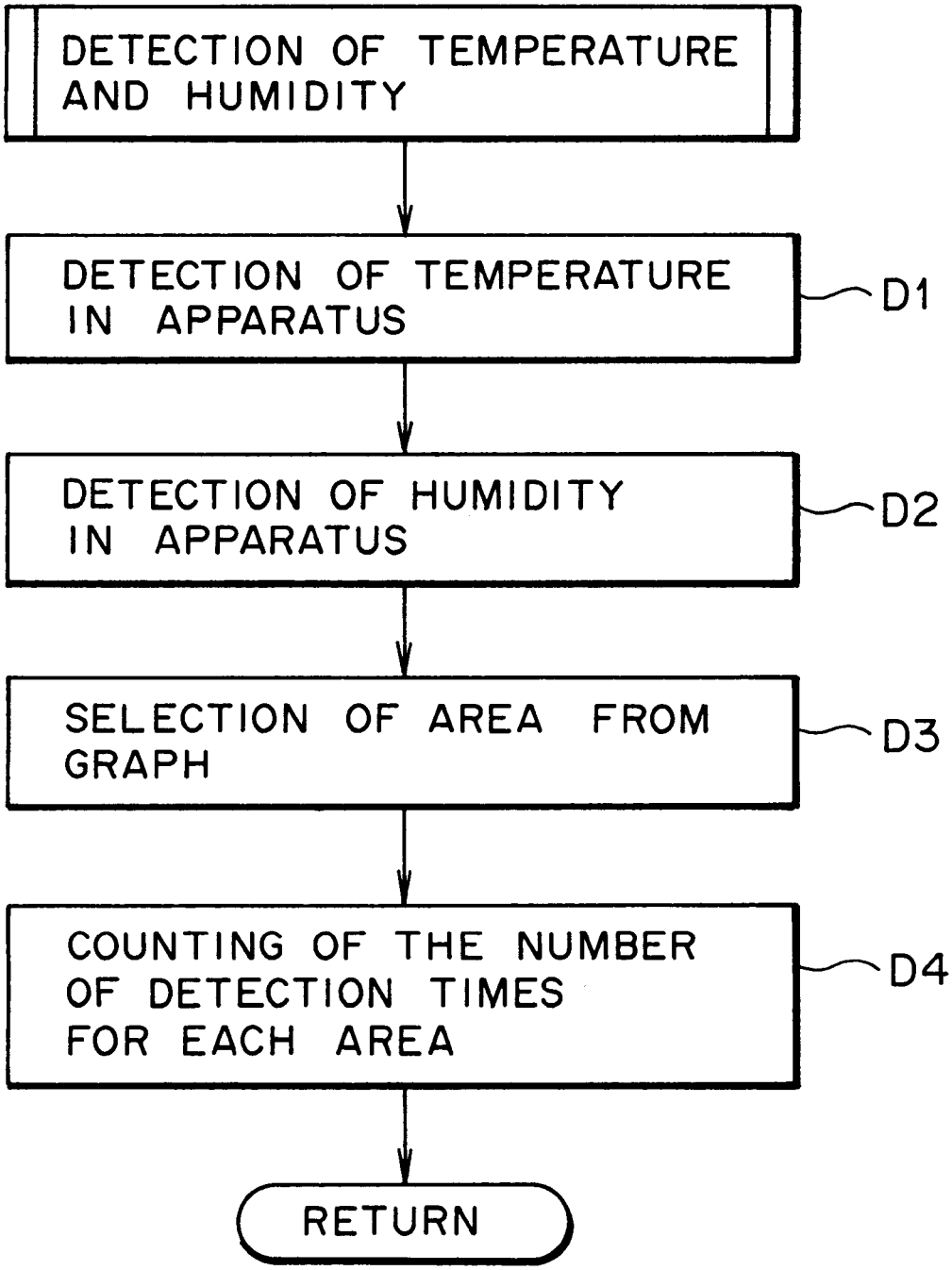
FIG. 7 is a flow chart useful for explaining the steps of determining the number of times of cleaning operation at cleaning of an electrifier of the image forming apparatus according to the first embodiment of this invention.
Figures 8, 9:
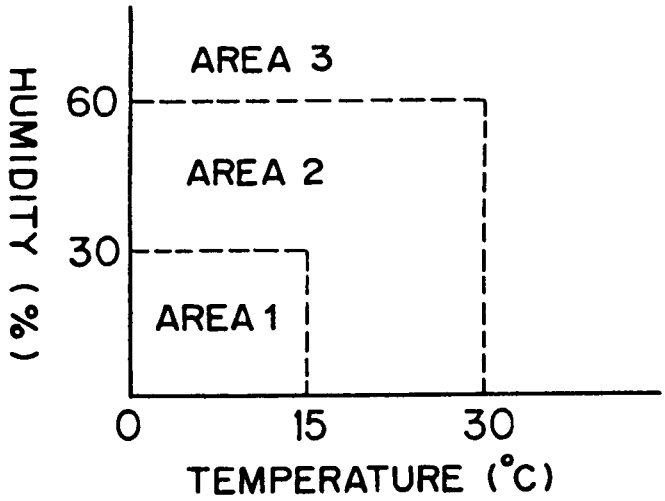
FIG. 8 is a graphic illustration of areas to be determined on the basis of a temperature and a humidity in the interior of the image forming apparatus according to the first embodiment of this invention.
FIG. 9 is an illustration of a table retaining a coefficient corresponding to each of the areas obtained as shown in FIG. 8.

Referring now to FIGS. 8 and 9, a description will be made hereinbelow of the process to obtain the number of times of cleaning operation at the cleaning of the pre-electrifier 11 according to the flow charts (steps C1 to C3, steps D1 to D4) of FIGS. 6 and 7.

FIG. 8 is a graphic illustration of areas to be determined on the basis of a temperature and a humidity in the interior of the image forming apparatus according to the first embodiment of this invention, and FIG. 9 is an illustration of a table retaining a coefficient corresponding to each of the areas obtained as shown in FIG. 8.

The control section 8 checks whether or not the photosensitive drum 2 is in rotation (step C1 in FIG. 6) and, if being in no rotation (see the NO route from step C1 in FIG. 6), waits continuously until the photosensitive drum 2 starts rotation. On the other hand, if the photosensitive drum 2 is in rotation (see the YES route from step C1 in FIG. 6), then the control section 8 checks the elapsed time from when the photosensitive drum 2 starts its rotation, to judge whether or not a predetermined time (M minutes) has elapsed from the start of rotation of the photosensitive drum 2 (step C2 in FIG. 6).

If the predetermined time (M minutes) has not elapsed yet from the start of rotation of the photosensitive drum 2 (see the NO route from step C2 in FIG. 6), the control section 8 again implements the steps C1 to C2. On the other hand, if the predetermined time (M minutes) has elapsed from the start of rotation of the photosensitive drum 2 (see the YES route from step C2 in FIG. 6), then the control section 8 measures the temperature and the humidity in the interior of the apparatus through the use of the temperature sensor 6 and the humidity sensor 7 (step C3 in FIG. 6, and steps D1 and D2 in FIG. 7). However, there is no limitation on the order of the measurement provided it is not constitute departures from the spirit and scope of the invention.

Furthermore, the control section 8 refers to a graph (see FIG. 8), stored in the storage section 10, on the basis of the in-apparatus temperature and humidity obtained by these measurements to select the corresponding area (one of areas 1 to 3) from this graph (step D3 in FIG. 7), and then refers to the table (see FIG. 9) stored in the storage section 10 to get a number of times of detection (A to C) corresponding to the selected area. And the control section 8 counts up to the number of times of detection got from the table (step D4 in FIG. 7) and subsequently clears the elapsed time (M minutes) from the start of rotation of the photosensitive drum 2. Thereafter, the control section 8 again returns to the step C1 in FIG. 6.

Incidentally, in FIG. 9, each of the reference characters A, B and C signifies the number of times of detection corresponding to each of the areas (1 to 3), while each of the reference characters X, Y and Z denotes a predetermined coefficient corresponding to each of the areas (1 to 3).

Still further, the control section 8 repeatedly implements the operations of the above-mentioned steps C1 to C3 and D1 to D4 to count the number of times of detection (A to C) corresponding to the areas in the table (see FIG. 9) stored in the storage section 10, and, for calculating the number of times of cleaning operation at the cleaning of the pre-electrifier 11, makes the calculation according to the following equation as a function of the number of times of detection (A to C) and the coefficients (X, Y, Z) corresponding to the areas in the table (see FIG. 9).

$$\text{Number of Times of Cleaning Operation}=(AX+BY+CZ)\pm(A+B+C)$$

In terms of this calculation result, the control section 8 counts fractions of 0.5 and over as a unit and cuts away the rest, and obtains the number of times of cleaning operation for the pre-electrifier 11 by the cleaning member 12.

Furthermore, at the cleaning of the pre-electrifier 11 by the cleaning member 12, the control section 8 oscillates the cleaning member 12 (moves the cleaning member 12 back and forth) according to (for) the number of times of cleaning operation thus obtained.

For instance, in carrying out an instruction for calculation of the number of times of cleaning operations for the pre-electrifier 11, in the case that A=12, B=18, C=3, X=2, Y=1 and Z=3 exist in the table (see FIG. 9) stored in the storage section 10, the number of times of cleaning operation is obtainable as follows.

$$\text{Number of times of cleaning operation}=(12\times2+18\times1+3\times3)\pm(12+18+3)=1.54\doteq2\ \text{(twice)}$$

Thus, the cleaning member 12 is oscillated twice at the cleaning of the pre-electrifier 11.

The storage section 10 is for previously storing various reference values to be used in the control section 8, in the first embodiment, retaining, as the reference values, for example, the values (the number of paper) 4000, 10000 and 20000 as the first predetermined value (first predetermined time), the second predetermined value (second predetermined time) and the third predetermined value (third predetermined time) signifying the cleaning timings for the pre-electrifier 11, and further retaining the information for the calculation of the coefficients determined in accordance with the detected temperature and humidity as shown in FIGS. 8 and 9.

Incidentally, the reference values and others stored in the storage section 10 are made to be variable by the operators and others.

The alarm issuing section 5 is for raising an alarm under control of the control section 8, and concretely for issuing an alarm in various ways, such as indicating an alarm message on a non-shown displaying section, lighting a non-shown alarm lamp and producing an alarm sound.

Figure 10:
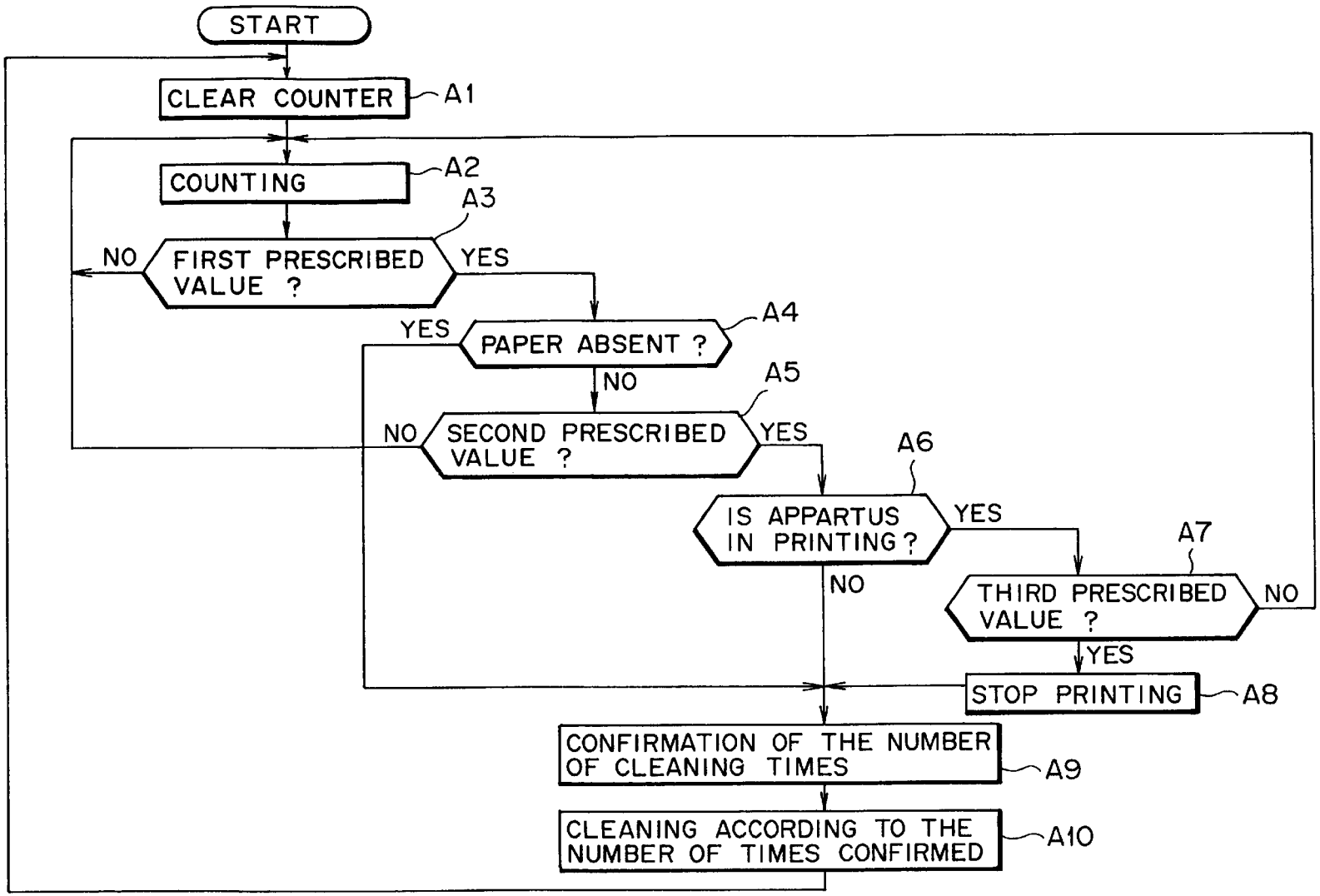
FIG. 10 is a flow chart available for describing an automatic electrifier cleaning method for the image forming apparatus according to the first embodiment of this invention.

The image forming apparatus according to the first embodiment of this invention is constructed as described above, and an automatic electrifier cleaning method in this apparatus will be described hereinbelow with reference to the flow chart (steps A1 to A10) of FIG. 10.

First of all, the control section 8, after initializing the counter 4 (step A1), starts to count the number of copies (step A2) concurrently with conducting the printing processing.

Subsequently, the control section 8 checks whether or not the number of copies counted reaches 4000 (first predetermined value) (step A3). If not reaching 4000 (see the NO route from step A3), then the control section 8 continues to conduct the printing operation and to count the number of copies.

On the other hand, if the number of copies exceeds 4000 (see the YES route from step A3), the control section 8 checks whether or not the paper sensor 23 has detected the printing paper 100 which permits printing (step A4). If the detection indicates that the printing paper 100 is absent on the conveying path near the photosensitive drum 2 (see the YES route from step A4), then the control section 8 confirms the number of times of cleaning operation obtained on the basis of the detection results of temperature and humidity in the aforesaid apparatus body (step A9).

Furthermore, the control section 8 oscillates the cleaning member 12 according to the number of times of cleaning operation confirmed to automatically clean the pre-electrifier 11 (step A10). Thereafter, the operational flow returns to the step A1.

Meanwhile, if the decision of the step A4 shows the presence of the printing paper 100 on the conveying path near the photosensitive drum 2 (see the NO route from step A4), then the control section 8 checks whether or not the number of copies counted by the counter 4 reaches 10000 (second predetermined value) (step A5).

If the number of copies does not reach 10000 (see the NO route from step A5), the printing and the counting are formed uninterruptedly. If the number of copies exceeds 10000 (see the YES route from step A5), then the control section 8 checks whether or not the apparatus is in printing (step A6) and, if being in stop (see the NO route from step A6), confirms the number of times of cleaning operation obtained on the basis of the temperature and humidity detection results in the aforesaid apparatus (step A9) and oscillates the cleaning member 12 according to the number of times of cleaning operation confirmed to automatically clean the pre-electrifier 11 (step A10). Thereafter, the operational flow returns to the step A1.

On the other hand, if being in printing (see the YES route from the step A6), then the control section 8 checks whether or not the number of copies counted by the counter 4 has reached 20000 (third predetermined value) (step A7).

If not reaching 20000 (see the NO route from step A7), the printing and the counting take place continuously. If exceeding 20000 (see the YES route from step A7), then the control section 8 sends, to the host computer 9, a signal for making a request for the stop of image data transmission so that the printing operation stops temporarily (step A8), and confirms the number of times of cleaning operation obtained on the basis of the temperature and humidity detection results of the interior of the aforesaid apparatus (step A9) to oscillate the cleaning member 12 according to the number of times of cleaning operation confirmed for the automatic cleaning of the pre-electrifier 11 (step A10), thereafter returning to the step A1.

As described above, with the image forming apparatus according to the first embodiment of this invention, when the paper sensor 23 detects the absence of the printing paper 100 after the number of copies reaches 4000 (first predetermined value), the pre-electrifier 11 is cleaned automatically, which enables the cleaning of the pre-electrifier 11 without interference with the printing operation, and which prevents reduction of the printing speed and the deterioration of the print quality resulting from the attachment of contaminants, such as toner and dust due to the cleaning of the pre-electrifier 11, to the printing paper 100, and further which suppresses the abrasion of the corona wires 11*a* to lengthen the electrifier's life.

Furthermore, after the number of copies reaches 10000 (second predetermined value), the automatic cleaning of the pre-electrifier 11 is made while the printing operation is in stop, which permits the cleaning of the pre-electrifier 11 without interference with the printing operation and which suppresses the wear of the corona wires 11*a* to lengthen the electrifier's life.

Still further, if the number of copies reaches 20000 (third predetermined value; the control section 8 transmits, to the host computer 9, a signal for a request for the stop of image data transmission so that the printing operation temporality comes to a stop before the automatic cleaning of the pre-electrifier 11. Thus, the contaminants such as toner and dust attached to the pre-electrifier 11 are removable so that the deterioration of the print quality is preventable.

In addition, since the control section 8 cleans the pre-electrifier 11 by oscillating the cleaning member 12 according to the number of times of cleaning operation obtained on the basis of the temperature and humidity detection results of the interior of the apparatus body, the cleaning operation for the pre-electrifier 11 can be conducted according to the number of times corresponding to the degree of contamination thereof, and it is possible to certainly remove the contaminants, such as toner attached to the pre-electrifier 11, without depending upon the using situations of this apparatus, which prevents the deterioration of the print quality. Besides, it is possible to suppress the wear of the corona wires 11, thereby lengthening the electrifier's life.

Still additionally, since the cleaning member 12 is built in the pre-electrifier unit 1 and is constructed to be attachable and detachable through the joining section 30 to/from the drive section 40 installed on the apparatus body side, at the replacement of the pre-electrifier unit 1, the replacement of only the cleaning member 12 accompanied with the pre-electrifier 11 is possible, but the replacement of the drive section 40 is not required, which lessens the cost needed for the replacement of the pre-electrifier unit 1 to economically reduce the apparatus operating cost.

Besides, also for the replacement of the drum unit 50, since there is no need to replace the drive section 40, it is possible to lessen the cost needed for the replacement of the drum unit 50 to economically reduce the apparatus operating cost.

Furthermore, for the replacement of the pre-electrifier unit 1, when the pre-electrifier unit 1, together with the photosensitive drum 2, is set in the apparatus body, since, on the apparatus body side, the joining section 30 is located at the home position and the photosensitive drum 2 is inserted thereinto in a state where the cleaning member 12 of the pre-electrifier unit 1 is placed at the innermost side (right side in FIG. 5) position in the inserting direction along the shaft of the photosensitive drum 2, in inserting the photosensitive drum 2 and the pre-electrifier unit 1 into the apparatus body, the cleaning member 12 is moved to slide in a direction along the rotary shaft of the photosensitive drum 2 while being supported by the stopper 31 of the joining section 30, so that the pre-electrifier 11 is cleaned at that time to improve the print quality.

Still further, at this time, since the stopper 31 comes into contact with the projecting portion 12*e* of the cleaning member 12 to position the cleaning member 12, for fixing the cleaning member 12 between the holding member 32 and the stopper 31 by rotating the lever 33 in the direction of the arrow c in FIG. 2, the projecting portion 12*e* can certainly and easily be fixed to the joining section 30, thereby improving the working efficiency in setting the pre-electrifier unit 1.

Moreover, since in this apparatus each of the levers and others is equipped with a mechanical interlock mechanism whereby the printing processing is inhibited if each of the levers and others is at a predetermined position, thus ensuring certain printing operations.

Besides, since the cleaning member 12 has an integrated structure so that a plurality of (4 in the first embodiment) corona wires 11*a* in the pre-electrifier 11 can be cleaned simultaneously, it is possible to improve the efficiency of the cleaning operation for the pre-electrifier 11, and to simplify the structures of the drive section 40 and the joining section 30, thus accomplishing a high economy.

(B) Description of a Second Embodiment

An image forming apparatus according to a second embodiment of this invention is similar in configuration to the image forming apparatus according to the first embodiment shown FIGS. 1 to 5.

In the image forming apparatus according to the second embodiment, the control section 8 is for controlling an operation of each of parts of this apparatus in accordance with an instruction coming from the host computer 9 like the control section 8 in the first embodiment. Additionally, the control section 8 is made to determine the number of times of cleaning operation by the cleaning member 12 at the cleaning in accordance with the using situation of the pre-electrifier 11, that is, the detection results of the temperature and the humidity in the apparatus body.

Furthermore, the control section 8 has an electric potential control function to determine a grid voltage (target electrification potential) to be applied to the grids 11*b* on the basis of a surface potential of the outer circumferential surface of the photosensitive drum 2 detected by the surface potential detecting section 15 and to apply this grid voltage to the grids 11*b* so that the electrification potential of the pre-electrifier 11 is controlled to maintain the surface potential of the photosensitive drum 2 at a predetermined electric potential.

Still further, immediately after initially making the cleaning member 12 clean the pre-electrifier 11, the control section 8 puts a grid voltage VG1 (predetermined reference voltage) for the pre-electrifier 11 determined by the aforesaid electric potential control function in the storage section 10.

Besides, this storage section 10 is made to store a first predetermined value a1 and a second predetermined value a2, which will be described herein later.

In addition, the control section 8 compares a grid voltage VG2 for the pre-electrifier 11, determined by the aforesaid electric potential control function, with the grid voltage VG1 stored in the storage section 10 to control the drive mechanism 60 so that the cleaning member 12 cleans the pre-electrifier 11 at a timing that the difference (VG2–VG1) between the grid voltage VG2 and the grid voltage VG1 exceeds the first predetermined value a1.

Still additionally, when the difference (VG2–VG1) between the grid voltage VG2 and the grid voltage VG1 exceeds the second predetermined value a2 greater than the first predetermined value a1, the control section 8 controls an alarm issuing section 5, which will be described later, to issue an alarm.

On the other hand, in the case that the difference (VG2–VG1) between the grid voltage VD2 and the grid voltage VG1 is larger than the first predetermined value a1 but smaller than the second predetermined value a2, the control section 8 controls the drive mechanism 60 to make the cleaning member 12 clean the pre-electrifier 11 for predetermined times and, after this cleaning, again detects the surface potential of the photosensitive drum 2 through the use of the surface potential detecting section 15 to compare a grid voltage VG2' for the pre-electrifier 11, depending on the surface potential after the cleaning, with the grid voltage VG1. If the difference (VG2'–VG1) between the grid voltage VG2' and the grid voltage VG1 is greater than the first predetermined value a1, the control section 8 controls the alarm issuing section 5, which will be described later, to raise an alarm.

Figure 11:
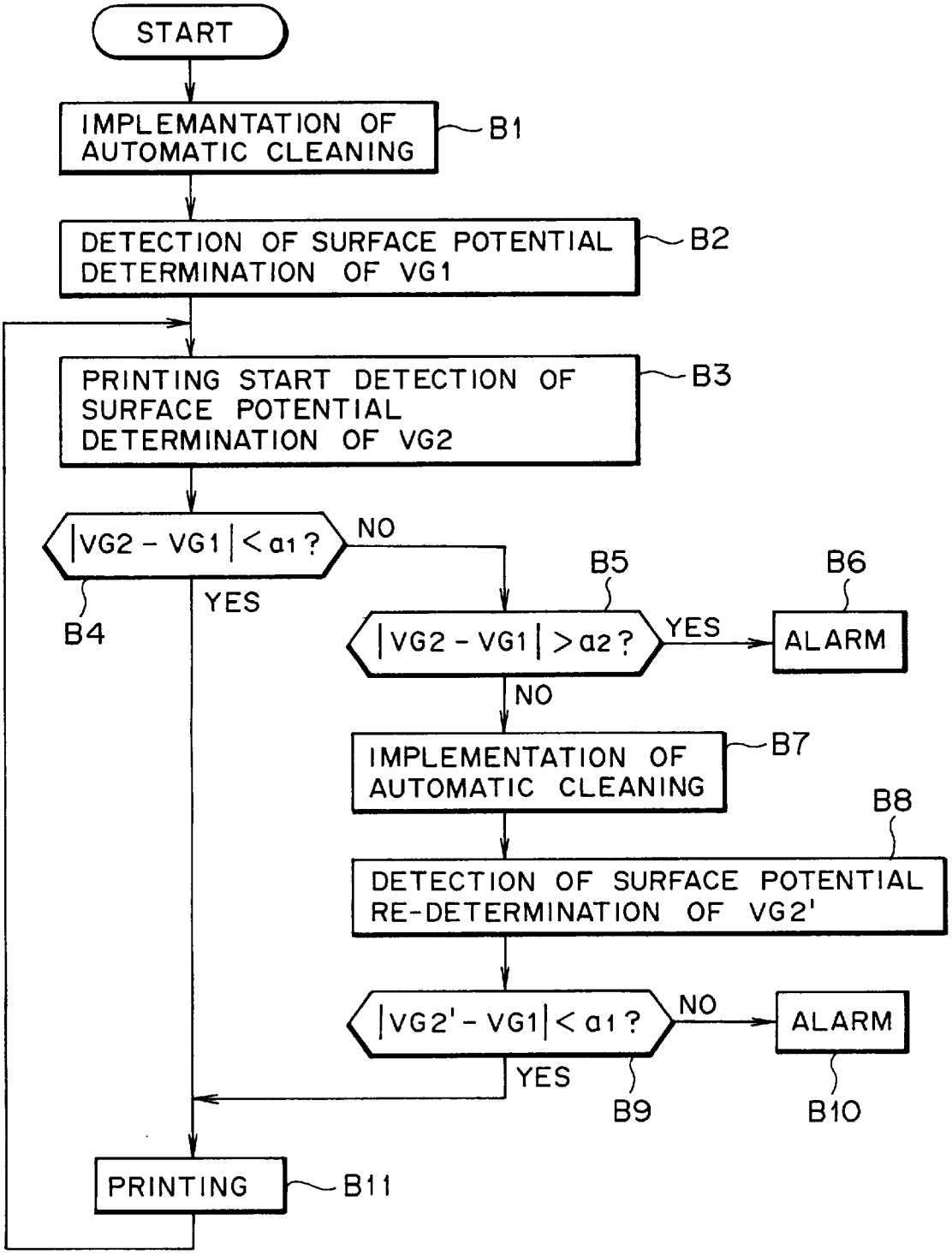
FIG. 11 is a flow chart available for describing a pre-electrifier control method for an image forming apparatus according to a second embodiment of this invention.

The image forming apparatus according to the second embodiment of this invention is constructed as described above, and a method of controlling the pre-electrifier 11 by the control section 8 in this apparatus will be described hereinbelow with reference to a flow chart (steps B1 to B11) of FIG. 11.

In case where a non-used drum unit 50 is set in the apparatus body, the control section 8 first automatically cleans the pre-electrifier 11 of a pre-electrifier unit 1, not put to use yet (step B1).

Subsequently, the control section 8 electrifies the outer circumferential surface of the photosensitive drum 2 through the use of the pre-electrifier 11, detects the surface potential of the photosensitive drum 2 through the use of the surface potential detecting section 15, determines the grid voltage VG1 to be applied to the grids 11*b* on the basis of the surface potential of the outer circumferential surface of the photosensitive drum 2 immediately after the pre-electrifier 11 is initially cleaned by the cleaning member 12 (step B2), and puts this grid voltage VG1 in the storage section 10.

Thereafter, the control section 8 starts the printing to the printing paper 100, detects the surface potential of the photosensitive drum 2 by the surface potential detecting section 15, and determines a grid voltage VG2 to be applied to the grids 11*b* on the basis of the detected surface potential (step B3).

Then, the control section 8 compares this grid voltage VG2 with the grid voltage VG1 existing in the storage section 10 to check whether or not the difference (VG2–VG1) between the grid voltage VG2 and the grid voltage VG1 is smaller than the first predetermined value a1 (step B4). If the difference (VG2–VG1) therebetween is smaller than the first predetermined value a1 (see the YES route from step B4), a decision is made that the pre-electrifier 11 is not so stained, thus continuing the printing operation (step B1). In this case, the operational flow returns to the step B3.

If the difference (VG2–VG1) between the grid voltage VG2 and the grid voltage VG1 is greater than the first predetermined value a1 (see the NO route from step B4), a decision shows that the pre-electrifier 11 is contaminated, and then a further decision is made as to whether or not the difference (VG2–VG1) between the grid voltage VG2 and the grid voltage VG1 is larger than the second predetermined value a2 (step B5).

At this time, if the difference (VG2–VG1) therebetween is larger than the second predetermined value a2 (see the YES route from step B5), the control section 8 makes a decision that a trouble (for example, disconnection of the corona wires 11*a,* abrasion of the photosensitive drum 2, or the like) to make it difficult to electrify the photosensitive drum 2 with a predetermined electric charge only by the cleaning of the pre-electrifier 11 exists in the photosensitive drum 2 or in the pre-electrifier unit 1 for some reasons, and makes the alarm issuing section 5 issue an alarm to urge the operator to do the inspection and replacement of the drum unit 50 (step B6).

On the other hand, if the difference (VG2–VG1) between the grid voltage VG2 and the grid voltage VG1 is smaller than the second predetermined value a2 (see the NO route from step B5), the control section 8 controls the drive mechanism 60 to make the cleaning member 12 oscillate according to the number of times of cleaning operation obtained on the basis of the detection results of the temperature and the humidity in the interior of the apparatus body, thereby accomplishing the automatic cleaning of the pre-electrifier 11 (step B7).

After this automatic cleaning, the control section 8 detects the surface potential of the photosensitive drum 2 through the surface potential detecting section 15, obtains the grid voltage VG2' for the pre-electrifier 11 on the basis of the detection result of the surface potential of the photosensitive drum 2 (step B8), and judges whether or not the difference (VG2'–VG1) between the obtained grid voltage VG2' and the grid voltage VG1 is smaller than the first predetermined value a1 (step B9).

If the difference (VG2'–VG1) therebetween is larger than the first predetermined value a1 (see the NO route from step B9), a decision is made that the pre-electrifier 11 is extremely stained so that difficulty is experience to remove the dirt attached to the pre-electrifier 11 even if the pre-electrifier 11 is cleaned by the cleaning member 12, and an alarm is issued from the alarm issuing section 5 to urge the operator to inspect and replace the photosensitive drum 2 or the pre-electrifier unit 1 (step B10).

On the other hand, if the difference (VG2'–VG1) between the grid voltage VG2' and the grid voltage VG1 is smaller than the first predetermined value a1 (see the YES route from step B9), the printing operation is continued (step B11), then followed by returning to the step B3.

In this way, with the image forming apparatus according to the second embodiment of this invention, for making the cleaning member 12 clean the pre-electrifier 11, the control section 8 compares the grid voltage VG2 for the pre-electrifier 11 determined by the electric potential control function with the grid voltage VG1 stored in the storage section 10 to control the drive mechanism 60 at the timing that the difference (VG2–VG1) between the grid voltage VG2 and the grid voltage VG1 exceeds the first predetermined value a1. Thus, when a need of the cleaning of the pre-electrifier 11 arises because contaminants such as toner adhere to the corona wires 11*a* or the like of the pre-electrifier 11, the automatic cleaning of the pre-electrifier 11 becomes possible and the removal of the contaminants such as toner attached to the pre-electrifier 11 becomes surely feasible without depending upon the using situation of this apparatus, which prevents the deterioration of the print quality and suppresses the wear of the corona wires 11*a* to lengthen the electrifier's service life.

In addition, since the control section 8 controls the alarm issuing section 5 to raise an alarm when the difference (VG2–VG1) between the grid voltage VG2 and the grid voltage VG1 exceeds the second predetermined value a2 greater than the first predetermined value a1, it is possible to inform the operator of the occurrence of troubles such as the disconnection of the corona wires 11*a* and the wear of the photosensitive drum 2 for some reasons, which makes it difficult to electrify the photosensitive drum 2 with a predetermined electric charge only by cleaning the pre-electrifier 11, thus permitting quick inspection, replacement or the like of the drum unit 50.

Still additionally, since the control section 8 issues an alarm through the control of the alarm issuing section 5 also in the case that the difference (VG2'–VG1) between the grid voltage VG2' for the pre-electrifier 11 determined by the surface potential after the cleaning and grid voltage VG1 by the comparison therebetween is greater than the first predetermined value a1, it is possible to inform the operator of the fact that the dirt attached to the pre-electrifier 11 cannot be removed only by the cleaning of the pre-electrifier 11 by the cleaning member 12, which enables quick inspection, replacement or the like of the drum unit 50.

(C) Others

In the above-described first embodiment, although the number of copies to the printing paper 100 is used as the electrification time by the pre-electrifier 11, this invention is not limited to this, but covering all changes and modifications, which do not constitute departures from the spirit and scope of the invention.

For instance, it is also appropriate that the time of electrification to the photosensitive drum 2 by the pre-electrifier 11 is measured by a timer or the like to thereby obtain the actual electrification time by the pre-electrifier 11, that the number of revolution of the photosensitive drum 2 is measured to be uses as the electrification time, that the electrification time by the pre-electrifier 11 is calculated on the basis of the time taken for the conveyance of the printing paper 100 (excluding the time taken for the auto-loading at the setting of the printing paper 100, and others), or that the information on the number of copies, together with image data, is obtained from the host computer 9 forming a host unit to calculate the number of copies on the basis of this information.

Furthermore, if the printing paper 100 is a continuous form, it is also appropriate that the number of copies to the printing paper 100 is calculated, for example, by measuring the length of the printing paper 100 used for printing and, since a portion between successive perforations made in the printing paper 100 can be handled as a piece of printing paper 100, dividing the actually used paper length by the length of the portion between the between successive perforations.

Moreover, in the above-described first embodiment, although, at the automatic cleaning for the pre-electrifier 11, the cleaning member 12 is oscillated according to the number of times calculated on the basis of the detection results of the temperature and the humidity in the interior of the apparatus, this invention is not limited to this, but covering all changes and modifications, which do not constitute departures from the spirit and scope of the invention.

For instance, in the case that the pre-electrifier 11 is automatically cleaned after the number of copies reaches 20000, it is considered that the degree of contamination of the pre-electrifier 11 at that time is higher than that in the case that the number of copies is 4000 or 10000. Further, in the case that the pre-electrifier 11 is automatically cleaned after the number of copies reaches 10000, it is similarly considered that the degree of contamination of the pre-electrifier 11 at that time is higher than that in the case that the number of copies is 4000. Accordingly, it is also appropriate to conduct the automatic cleaning operation for times above the number of times of cleaning operation obtained from the temperature, the humidity and others in the apparatus body as described above.

Furthermore, in the above-described first embodiment, although the number of copies is counted using the counter 4 for obtaining the electification time by the pre-electrifier 11, this invention is not limited to this but it is also possible that a timer is provided to measure the electrification time by the pre-electrifier 11 and the actual electrification time by the pre-electrifier 11 is measured using this timer. That is, it is possible to make all changes and modifications, which do not constitute departures from the spirit and scope of the invention.

Still further, in the above-described second embodiment, although the grid voltage VG1 for the pre-electrifier 11 determined by the aforesaid electric potential control function immediately after the pre-electrifier 11 is initially cleaned by the cleaning member 12 is used as a predetermined reference potential, this invention is not limited to this, but it is also possible to predetermine a given voltage value in advance. That is, it is possible to make all changes and modifications, which do not constitute departures from the spirit and scope of the invention.

Moreover, in the description of the first and second embodiments, although the cleaning member 12 is made to clean only the chassis 70 and the corona wires 11*a* in the pre-electrifier 11, this invention is not limited to this, but it is also appropriate that cleaning members are provided in the transfer section 20 to clean the corona wires 21*a*, 22*a* and others of the transfer electrifier 21 and the separation electrifier 22 and, light the cleaning member 12 in the above-described first embodiment, the cleaning members are made to be detachable from the apparatus body and the transfer section 20 is automatically cleaned through the use of these cleaning members. In addition, it is also possible to, at the automatic cleaning of the transfer section 20 by the cleaning members, conduct the automatic cleaning at the timing similar to that in the first or second embodiment, or to clean the transfer section 20 according to the number of times of cleaning operation calculated like the above-described modification. That is, it is possible to make all changes and modifications, which do not constitute departures from the spirit and scope of the invention.

Moreover, this invention is not limited to the above-described embodiments, but it is intended to cover all changes and modifications of the embodiments of the invention, which do not constitute departures from the spirit and scope of the invention. Thus, it is also acceptable that the control section 8 compares the number of copies to the printing paper 100 measured by the counter 4 with the first predetermined value, the second predetermined value and the third predetermined value stored in the storage section 10 for deciding the cleaning timing for the pre-electrifier 11 like the above-described first embodiment, and further compares the difference (VG2−VG1) between the grid voltage VG2 for the pre-electrifier 11 determined by the electric potential control function and the grid voltage VG1 with the first predetermined value a1 for judging the cleaning timing for the pre-electrifier 11 like the above-described second embodiment, and even compares the difference (VG2−VG1) between the grid voltage VG2 for the pre-electrifier 11 and the grid voltage VG1 or the difference (VG2'−VG1) between the grid voltage VG2' and the grid voltage VG1 with the first predetermined value a1 or the second predetermined value a2 for controlling the alarm issuing section 5 on the basis of the comparison result to issue an alarm.

What is claimed is:

1. An automatic cleaning method of automatically cleaning, with a cleaning member, an electrifier for an image forming apparatus which forms an image on a medium, said method comprising the steps of:

measuring an electrification time of the electrifier after the last electrifier cleaning;

discriminating whether or not the medium is located at an image forming station;

if the medium is absent at the image forming station after said electrification time reaches a first predetermined time, cleaning the electrifier with said cleaning member;

if the medium is located at the image forming station after said electrification time reaches said first predetermined time and if said electrification time reaches a second predetermined time subsequent to said first predetermined time, cleaning the electrifier with said cleaning member when an image forming operation of the image forming apparatus is stopped; and if said electrification time reaches a third predetermined time subsequent to said second predetermined time with the image forming operation kept continuing, temporarily stopping the image forming operation even before the electrifier is cleaned with the cleaning member.

2. An automatic cleaning method as defined in claim 1, wherein, when said image forming operation is temporarily stopped, a request for a stop of transmission of image data is issued to a host unit which transmits the image data to the image forming apparatus.

3. An automatic cleaning method as defined in claim 2, wherein a number of times the cleaning step is performed is determined according to how the electrifier has been used, whereupon the cleaning operation is performed by the cleaning member according to the determined number of times.

4. An automatic cleaning method as defined in claim 3, wherein such using situation of the electrifier is evaluated in terms of said electrification time.

5. An automatic cleaning method as defined in claim 3, wherein such using situation is evaluated in terms of a temperature in the image forming apparatus.

6. An automatic cleaning method as defined in claim 3, wherein such using situation of the electrifier is evaluated in terms of a humidity in said image forming apparatus.

7. An automatic cleaning method as defined in claim 1, wherein a number of times the cleaning step is performed is determined according to how the electrifier has been used, whereupon the cleaning operation is performed by the cleaning member according to the determined number of times.

8. An automatic cleaning method as defined in claim 7, wherein such using situation of the electrifier is, evaluated in terms of said electrification time.

9. An automatic cleaning method as defined in claim 7, wherein such using situation is evaluated in terms of a temperature in the image forming apparatus.

10. An automatic cleaning method as defined in claim 7, wherein such using situation of the electrifier is evaluated in terms of a humidity in the image forming apparatus.

11. An automatic cleaning method of automatically cleaning, with a cleaning member, an electrifier for an image forming apparatus which forms an image on an image forming drum electrified by the electrifier and transfers the image from the image forming drum onto a medium for an image forming on said medium, the image forming apparatus having an electric potential control function to control an electrification potential of the electrifier in accordance with a surface electric potential of the image forming drum, said method comprising the steps of:

determining a target electrification potential for the electrifier potential control function of the image forming apparatus; and cleaning an electrifying member of the electrifier when a difference between the determined target electrification potential for the electrifier and a predetermined reference potential exceeds a first predetermined value.

12. An automatic cleaning method as defined in claim 11, wherein an alarm is issued when the difference between said target electrification potential for the electrifier and said predetermined reference potential exceeds a second predetermined value greater than said first predetermined value.

13. An automatic cleaning method as defined in claim 12, wherein an alarm is issued when the difference between said target electrification potential for the electrifier, which potential is determined by said electric potential control function immediately after the cleaning by the cleaning member, and said predetermined reference potential exceeds said first predetermined value.

14. An automatic cleaning method as defined in claim 13, wherein said predetermined reference potential is a target electrification potential for the electrifier which potential is determined by the electric potential control function immediately after the electrifier is initially cleaned by the cleaning member.

15. An automatic cleaning method as defined in claim 12, wherein said predetermined reference potential is a target electrification potential for the electrifier which potential is determined by the electric potential control function immediately after the electrifier is initially cleaned by the cleaning member.

16. An automatic cleaning method as defined in claim 11, wherein said predetermined reference potential is a target electrification potential for the electrifier which potential is determined by the electric potential control function immediately after the electrifier is initially cleaned by the cleaning member.

17. An image forming apparatus equipped with an electrifier which performs an electrifying operation for the purpose of forming an image on a medium, said apparatus comprising:

a cleaning member for cleaning said electrifier;

a drive mechanism for moving said cleaning member to clean said electrifier;

an electrification time measuring section, initialized upon completion of each cleaning of said electrifier, for measuring an electrification time after the cleaning of said electrifier;

a medium detecting section for discriminating whether or not a medium is located at an image forming station where an image is formed on the medium; and a control section for controlling said drive mechanism to move said cleaning member so as to clean said electrifier when said medium detecting section discriminates the absence of the medium at the image forming station after said electrification time measured by said electrification time measuring section reaches a first predetermined times, said control section being operative to render said cleaning member to clean said electrifier when it is detected that an image forming operation of said apparatus is stopped, after said electrification time reaches a second predetermined time subsequent to said first predetermined time without any detection of the absence of said medium by said medium detecting section, and said control section being operative, if said electrification time reaches a third predetermined time subsequent to said second predetermined time with said image forming operation kept continuing, to temporarily stop said image forming operation before rendering said cleaning member to clean said electrifier.

18. An image forming apparatus as defined in claim 17, wherein, when said image forming operation is to be temporarily stopped, said control section issues a request, for a stop of transmission of image data, to a host unit which transmits image data to said apparatus.

19. An image forming apparatus as defined in claim 18, wherein, when said electrifier is to be cleaned with said cleaning member, said control section determines the number of times of cleaning operation with said cleaning member according to how said electrifier has been used, and performs said cleaning operation with said cleaning member according to the determined number of times.

20. An image forming apparatus as defined in claim 19, wherein such using situation of said electrifier is evaluated in terms of said electrification time.

21. An image forming apparatus as defined in claim 19, wherein such using situation of said electrifier is evaluated in terms of a temperature in said image forming apparatus.

22. An image forming apparatus as defined in claim 19, wherein such using situation of said electrifier is evaluated in terms of a humidity in said image forming apparatus.

23. An image forming apparatus as defined in claim 17, wherein, when said electrifier is to be cleaned with said cleaning member, said control section determines the number of times of cleaning operation with said cleaning member according to how said electrifier has been used, and performs said cleaning operation with said cleaning member according to the determined number of times.

24. An image forming apparatus as defined in claim 23, wherein such using situation of said electrifier is evaluated in terms of said electrification time.

25. An image forming apparatus as defined in claim 23, wherein such using situation of said electrifier is evaluated in terms of a temperature in said image forming apparatus.

26. An image forming apparatus as defined in claim 23, wherein such using situation of said electrifier is evaluated in terms of a humidity in said image forming apparatus.

27. An image forming apparatus which forms an image on an image forming drum by electrifying with an electrifier and transfers the image onto a medium, and which has an electric potential control function to control an electrification potential of said electrifier in conformity to a target value in accordance with a surface electric potential of said image forming drum, said apparatus comprising:

a cleaning member for cleaning said electrifier;

a drive mechanism for moving said cleaning member to clean said electrifier; and a control section for controlling said drive mechanism to move said cleaning member so as to clean said electrifier when a difference between said target electrification potential, which is determined by said electric potential control function, and a predetermined reference potential exceeds a first predetermined value.

28. An image forming apparatus as defined in claim 27, further comprising an alarm issuing section for issuing an alarm under control of said control section, said control section being operable to render said alarm issuing section to issue an alarm when the difference between said target electrification potential and said predetermined reference potential exceeds a second predetermined value greater than said first predetermined value.

29. An image forming apparatus as defined in claim 28, wherein said control section renders said alarm issuing section to issue an alarm when the difference between said target electrification potential, which is determined by said electric potential control function immediately after the cleaning with said cleaning member, and said predetermined reference potential exceeds said first predetermined value.

30. An image forming apparatus as defined in claim 29, wherein said predetermined reference potential is a target electrification potential determined by said electric potential control function immediately after the initial cleaning of said electrifier with said cleaning member.

31. An image forming apparatus as defined in claim 28, wherein said predetermined reference potential is a target electrification potential determined by said electric potential control function immediately after the initial cleaning of said electrifier with said cleaning member.

32. An image forming apparatus as defined in claim 27, wherein said predetermined reference potential is a target electrification potential determined by said electric potential control function immediately after the initial cleaning of said electrifier with said cleaning member.

33. An image forming apparatus including an electrifier which performs an electrifying operation for the purpose of forming an image on a medium, said apparatus comprising:

a cleaning member, located in an electrifier unit in which said electrifier is disposed for cleaning said electrifier;

a drive mechanism, mounted on a frame of said image forming apparatus, for moving said cleaning member to clean said electrifier; and a joining unit attached to said drive mechanism at a position in which said drive mechanism moves said cleaning member, said joining unit being located to selectively assume a connecting position connecting to said cleaning member to prevent said cleaning member from being removed from said drive mechanism or a releasing position releasing from said cleaning member to allow said cleaning member to be removed from said drive mechanism, wherein said joining unit is locatable to assume said releasing position so that said cleaning member is removed from both the drive mechanism and said joining unit for replacement of said electrifier unit together with said cleaning member and said electrifier.

34. An image forming apparatus as defined in claim 33, wherein said apparatus is a multi-electrifier type comprising a plurality of electrifiers including the first-named electrifier, and a plurality of cleaning members including the first-named cleaning member for cleaning the respective electrifiers, said cleaning members being combined in a unitary form so as to be moved by the common drive mechanism.

35. An image forming apparatus as defined in claim 34, wherein said drive mechanism includes a joining section to be joined with said cleaning members and a drive section for moving said joining section along said electrifiers, said joining section having a contacting portion to be brought into contact with said cleaning members when setting of said electrifier unit which positions said cleaning members, and a fixing mechanism for fixing said cleaning members, which is positioned by said contacting section, with respect to said contacting section.

36. An image forming apparatus as defined in claim 35, further comprising an image forming drum for forming an image to be transferred onto the medium, said electrifier unit being combined with a drum unit in a unitary form, said drum unit including said image forming drum so that said electrifier unit together with said image forming drum can be removed as said drum unit is removed for replacement.

37. An image forming apparatus as defined in claim 34, further comprising an image forming drum for forming an image to be transferred onto the medium, said electrifier unit being combined with a drum unit in a unitary form, said drum unit including said image forming drum so that said electrifier unit together with said image forming drum can be removed as said drum unit is removed for replacement.

38. An image forming apparatus as defined in claim 33, further comprising an image forming drum for forming an image to be transferred onto the medium, said electrifier unit being combined with a drum unit in a unitary form, said drum unit including said image forming drum so that said electrifier unit together with said image forming drum can be removed as said drum unit is removed for replacement.

* * * * *